United States Patent [19]

Lohrmann et al.

[11] Patent Number: 4,650,358

[45] Date of Patent: Mar. 17, 1987

[54] FEEDER FOR A PRINTER

[75] Inventors: Gerhard Lohrmann, Elchingen/Thalfingen; Kurt Röehrer, Niederstotzingen, both of Fed. Rep. of Germany

[73] Assignee: Mannesmann Aktiengesellschaft, Duesseldorf, Fed. Rep. of Germany

[21] Appl. No.: 719,241

[22] Filed: Apr. 2, 1985

[30] Foreign Application Priority Data

Apr. 3, 1984 [DE] Fed. Rep. of Germany ..... 3412852

[51] Int. Cl.[4] ..... B41J 11/32; B41J 11/34

[52] U.S. Cl. ..... 400/616.2; 226/86; 226/74; 226/196; 16/296; 16/293; 16/373; 16/386

[58] Field of Search ..... 400/616, 616.1, 616.2; 226/74, 76, 86, 196, 199; 16/293, 296, 373, 386

[56] References Cited

U.S. PATENT DOCUMENTS

| | | | |
|---|---|---|---|
| 2,342,477 | 2/1944 | Magnenat | 16/296 |
| 2,442,873 | 6/1948 | Graham | 16/373 |
| 2,707,800 | 5/1955 | Popper | 16/296 |
| 2,797,434 | 7/1957 | Vigmostad | 16/293 |
| 2,987,332 | 6/1961 | Bonmartini | 16/386 |
| 3,388,420 | 6/1968 | Ballantyne | 16/386 |
| 3,545,034 | 12/1970 | Wright | 16/293 |
| 4,390,002 | 6/1983 | Daily, III | 16/373 |
| 4,493,680 | 1/1985 | Hoffmann | 16/386 |

FOREIGN PATENT DOCUMENTS

| | | | |
|---|---|---|---|
| 1180959 | 2/1970 | United Kingdom | 400/616.2 |

OTHER PUBLICATIONS

"Snap Close Tractor Lid" Research Disclosure, Aug. 1985, No. 256, Kenneth Mason Publications Ltd., England.

*Primary Examiner*—William Pieprz

*Attorney, Agent, or Firm*—Oblon, Fisher, Spivak, McClelland & Maier

[57] ABSTRACT

A feeder for a printer serves for guiding and/or advancing the record carrier. Tractors (1*a* and 1*b*) placed in a pair are provided. The tractors (1*a* and 1*b*) have hinged parts which can be adjusted in different hinged positions by pivoting bearings (11). To provide hinged part on printers, particularly dot matrix printers, with simple pivoting bearings that can be produced economically and to eliminate a special fastener for the pivoted positions, a spring steel wire piece (18) cut to length serves as a pivot pin (17) and for fixing of the closed and open end positions of the hinged part (10). The spring steel wire piece (18) is put under tension by bending.

7 Claims, 2 Drawing Figures

FEEDER FOR A PRINTER

FIELD OF THE INVENTION

The invention relates to a feeder for a printer, particularly a dot matrix printer. The feeder is provided with a pair of tractors for guiding and/or advancing the record carrier, and hinged parts of the tractor are fastened pivotally.

BACKGROUND OF THE INVENTION

Feeders for printers accomplish the line-by-line, step-by-step, or continuous advance of the record carriers (which consist, e.g., of paper webs). For a trouble-free operation of a printer, it is important that the beginning of the paper web be put expertly in the advance or guide elements of the feeder.

When putting the paper web on the pins of the belt fastener of a tractor, it is necessary, for example, to swing away the tractor flaps (i.e., covers) which hold the paper web on the pins. Therefore, tractor flaps are held movably in pivoting bearings.

Introduction of the paper web from the underside or backside of the printer also makes the swinging out of hinged parts by means of pivoting bearings necessary in some printer designs.

For shipping, swinging in of the hinged elements, which are swung out during operation, is advantageous to save shipping and packing space.

All of the examples given above have the disadvantage that hinged parts on printers require a considerable expenditure for pivoting bearings. An additional expenditure arises if the hinged part must further be fixed in the positions to which it is pivotable. An expenditure in this connection is hardly economically justifiable.

OBJECTS OF THE INVENTION

Therefore, the principle object of the invention is to provide a simple pivoting bearing for hinged parts on the printers.

A further object of the invention is to provide a simple fastener for the hinged positions.

SUMMARY OF THE INVENTION

The objects of the invention are obtained by the provision of a spring steel wire piece cut to length. The spring steel wire piece is put under tension by bending, and it serves as a pivot pin. Additionally, the spring steel wire piece fixes the hinged parts in closed or open position.

This invention provides the necessary pivoting joint in an economical and simple way. Additionally, it allows fastening of the hinged part in the desired end positions.

A preferred embodiment of the invention is designed so that the tractor bearings in which the ends of the spring steel wire piece is mounted are provided on the tractor body separated in the advance direction. Further, a hinged part bearing with a through-hole for the spring steel wire piece is provided on the hinged part between the tractor bearings of the tractor body. In the closed and open end positions, the hinged part bearing or bearings adjoin outside, planar surfaces on a planar counter surface of the tractor body. The axes of the bores in the tractor bearings and the axis of the hinged part bearing are parallel to but spaced from one another.

A functionally inverse design consists in that hinged part end bearings, in which the ends of the spring steel wire pieces are mounted, are provided on the hinged parts separated in the advance direction. Further, a tractor bearing with a through-hole for the spring steel wire piece is provided on the tractor body between the hinged part end bearings. In the closed and open end positions, the hinged part end bearings adjoin outside, planar surfaces on a planar counter surface of the tractor body. The axes of the through-holes in the tractor bearings and the axes of the hinged part end bearings are parallel to but spaced from one another.

The spring steel wire piece can be prevented from falling out by the ends of the spring steel wire piece being pinched.

The effects according to the invention occur with the hinged parts for printers when the parallel axes of the bores in the tractor bearings and in the hinged part bearings are at a distance of about 0.8 mm.

The practical fixing positions are advantageously achieved by the outside planar counter surface of the tractor body and the planar surfaces of the hinged part bearings for the closed and open positions being at approximately 90° to another.

Application of the invention to a dot matrix printer occurs by the hinged part consisting of a cover flap for the belt fastener of the tractor.

Another applicability is obtained by the hinged part consisting of a side guide flap for the record carrier.

Embodiments of the invention are shown in the drawings and are described in detail below.

DETAILED DESCRIPTION OF THE PRESENTLY PREFERRED EMBODIMENTS

Figure 1:
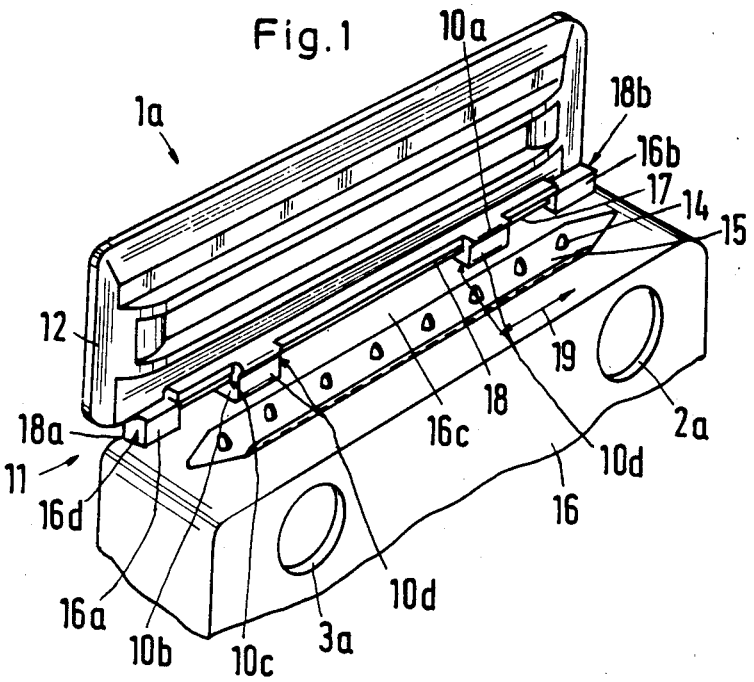
FIG. 1 is a perspective view of the top part of a tractor of a dot matrix printer.

The tractor according of FIG. 1 is shown without the record carrier. However, the tractor shown is placed in a pair on the left and right of the record carrier. A left tractor 1*a* can be seen in FIG. 1, and a right tractor 1*b* can be seen in FIG. 2. In use, the two tractors 1*a* and 1*b* are carried on a fastening rod 2 and a drive shaft 3. The fastening rod 2 and the drive shaft 3 are adjusted to be exactly parallel by side supports 4 and set screws 5. The fastening rod 2 runs through a bore 2*a*, and the drive shaft 3, which is square in cross section, runs through a square bushing which is inserted into a bore 3*a*. In this case, the drive shaft 3 is rotatably mounted in a bushing 6 fastened on the side support 4. The record carrier rests at one spot on a wing 7 of a guide wall flap 8 and later at another spot on a support 9.

Figure 2:
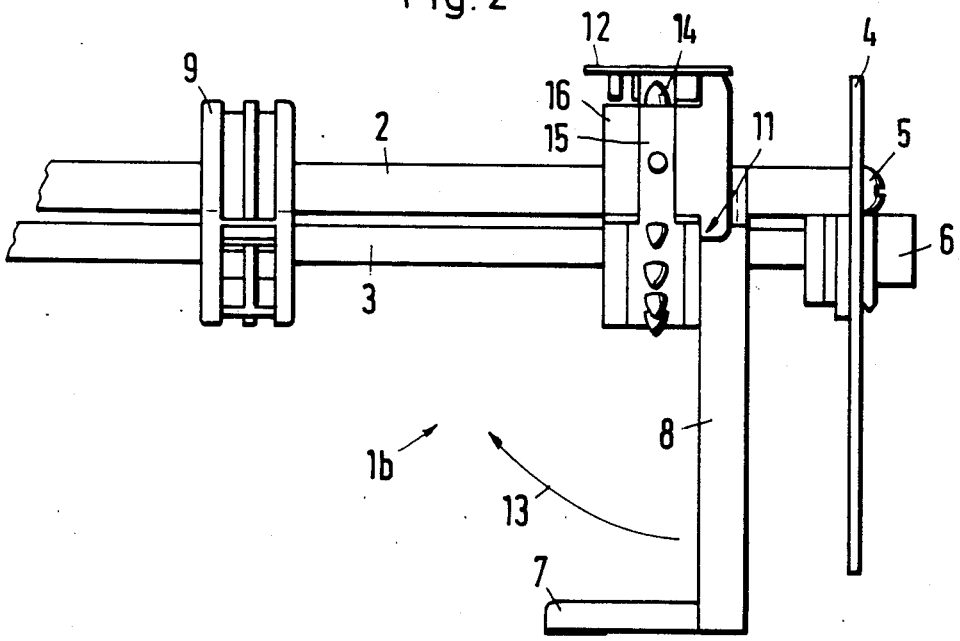
FIG. 2 is a view of the right part of a feeder, including a tractor and an additional guide for the record carrier, seen approximately in the feed direction of the record carrier.

The tractors shown in FIGS. 1 and 2 have pivoting bearings 11 for the two different hinged parts. According to FIG. 1, the hinged part consists of a cover flap 12 pivotable about a pivoting bearing 11. According to FIG. 2, the hinged part consists of the guide wall flap 8, which is likewise pivotable about a pivoting bearing 11. While the guide wall flap 8 can be swung in the direction indicated by an arrow 13 for shipping or packing, swinging out and in of the cover flap 12 is for putting in the edge-punched record carrier—i.e., the edge-punched paper web. The paper web is put with its pin holes on pins 14 of belt fastener 5, which is carried in tractor body 16. Then cover flap 12 is swung from the vertical position shown to the horizontal position, in which it covers belt fastener 15.

Each of the pivoting bearings 11 comprise pivot pins 17 in the form of spring steel wire pieces 18 cut to length. Tractor bearings 16*a* and 16*b* containing bores 16*d* in which ends 18*a* and 18*b* of spring steel wire piece 18 are mounted are provided on the tractor body 16 separated in the advance direction 19. The hinged part (i.e., either the guide wall flap 8 or the cover flap 12) carries two hinged part bearings 10*a* and 10*b* which in each case are provided with a through-hole 10*c*.

The spring steel wire piece 18 runs in through-holes 10*c*. The hined part bearings 10*a* and 10*b* have outside, planar surfaces 10*d* which rest on a planar counter surface 16*c* on the tractor body 16. The spring steel wire piece 18 is straight in its relaxed condition, but it is slightly bent when put through the through-holes 10*c*. That is, the spring steel wire piece 18 is put under spring tension. This tension is achieved by an offset of about 0.8 mm between the axes of the through-holes 10*c* and the axes of the bores 16*d* in the tractor bearings 16*a* and 16*b*. The planar surfaces 10*d* on the hinged part define the open and closed end positions of the hinged part, and the spring steel wire piece 18 alternately resiliently biases the hinged part towards each of the two end positions. As the hinged part is pivoted from one end position to the other, the spring steel wire piece 18 passes through an over-center position.

The effects described are obtained by at least one tractor bearing (16*a* or 16*b*) being provided on-center on tractor body 16, while the hinged part swings relative to the tractor body 16 on the hinged part bearings (10*a*, 10*b*).

The spring steel wire piece 18 is preferably pinched at its ends 18*a* and 18*b* to prevent its falling out of the tractor bearing 16*a* and 16*b*.

For putting in the paper web or for packing it, it is advantageous if the cover flap 12 can be put upright—i.e., vertical and fixed. For this purpose, the outside, planar counter surface 16*c* on the tractor body 16 runs at 90° to the corresponding surfaces 10*d* of the hinged part bearings 10*a* and 10*b* on the cover flap 12.

The principle of this invention can be applied both for the cover flap 12 for the belt fastener 15 and for the guide wall flap 8 for the record carrier.

Additionally, this principle can be applied to all flap parts of a printer, particularly of a dot matrix printer.

What is claimed as new and desired to be secured by Letters Patent of the United States is:

1. A feeder for a printer, said feeder comprising:

(a) a pair of spaced side supports;

(b) a fastening rod extending between said pair of spaced side supports;

(c) a drive shaft extending between said pair of spaced guide supports parallel to said fastening rod; and (d) a pair of tractors mounted on said fastening rod and said drive shaft between said pair of spaced side supports, each one of said pair of tractors comprising:

(i) a tractor body;

(ii) at least one hinged part; and (iii) a pivoting bearing connecting said at least one hinged part to said tractor body and permitting movement of said at least one hinged part back and forth between a first position and a second position, and pivoting bearing comprising a spring steel wire piece which serves as a pivot pin which is resiliently distorted in each of said first and second positions so that said spring steel wire piece resiliently biases said at least one hinged part towards first one and then the other of said first and second positions, wherein:

(iv) said spring steel wire piece passes through an over-center position as said at least one hinged part passes between said first and second positions;

(v) said spring steel wire piece is straight prior to being assembled into said pivoting bearing:

(vi) the ends of said spring steel wire piece are received in journals in spaced bearings on one of said tractor body and said at least one hinged part;

(vii) said spring steel wire piece passes through a through-hole in at least one bearing on the other one of said tractor body and said at least one hinged part; and (viii) the axes of said journals in said spaced bearings are coaxial, but the axis of said through-hole in said at least one bearing is parallel to but not coaxial with the axes of said journals in said spaced bearings, which causes said spring steel wire piece to bend in order to pass through said through-hole, thereby resiliently biasing said at least one hinged part towards first one and then the other of said first and second positions.

2. A feeder as recited in claim 1, wherein said spring steel wire piece passes through at least two spaced through-holes in at least two bearings on the other one of said tractor body and said at least one of hinged part.

3. A feeder as recited in claim 1, wherein:

(a) the ends of said spring steel wire piece are received in journals and spaced bearings on said tractor body and (b) said spring steel wire piece passes through a through-hole in at least one bearing on said at least one hinged part.

4. A feeder as recited in claim 1, wherein said at least one hinged part has two planar surfaces which make planar contact with said tractor body in said first and second positions, respectively.

5. A feeder as recited in claim 1, wherein said two planar surfaces on said at least one hinged part are perpendicular to one another.

6. A feeder as recited in claim 1, wherein:

(a) said tractor comprises a belt fastener and (b) said at least one hinged part is a cover flap for said belt fastener.

7. A feeder as recited in claim 1, wherein:

(a) said tractor comprises a side guide flap and (b) said at least one hinged part is said side guide flap.

* * * * *